US009776422B2

(12) United States Patent
Govyadinov

(10) Patent No.: US 9,776,422 B2
(45) Date of Patent: Oct. 3, 2017

(54) SYSTEMS AND METHODS FOR DEGASSING FLUID

(71) Applicant: HEWLETT-PACKARD DEVELOPMENT COMPANY, L.P., Houston, TX (US)

(72) Inventor: Alexander Govyadinov, Corvallis, OR (US)

(73) Assignee: HEWLETT-PACKARD DEVELOPMENT COMPANY, L.P., Houston, TX (US)

( * ) Notice: Subject to any disclaimer, the term of this patent is extended or adjusted under 35 U.S.C. 154(b) by 0 days.

(21) Appl. No.: 15/379,730

(22) Filed: Dec. 15, 2016

(65) Prior Publication Data

US 2017/0096016 A1 Apr. 6, 2017

Related U.S. Application Data

(63) Continuation of application No. 15/064,487, filed on Mar. 8, 2016, now Pat. No. 9,561,666, which is a (Continued)

(51) Int. Cl.
*B41J 2/19* (2006.01)
*B41J 2/18* (2006.01)
(Continued)

(52) U.S. Cl.
CPC ..... *B41J 2/19* (2013.01); *B41J 2/0458* (2013.01); *B41J 2/04596* (2013.01);
(Continued)

(58) Field of Classification Search
CPC ..... B41J 2/19; B41J 2/18; B41J 2/1652; B41J 2/04596; B41J 2/14032; B41J 2/0458; B41J 2002/14169; B41J 2202/07
See application file for complete search history.

(56) References Cited

U.S. PATENT DOCUMENTS 4,638,337 A 1/1987 Torpey et al.
5,341,162 A 8/1994 Hermanson et al.
(Continued)

FOREIGN PATENT DOCUMENTS

CN 1709699 12/2005
EP 0710562 5/1996
(Continued)

OTHER PUBLICATIONS

European Patent Office, "Communication pursuant to Article 94(3) EPC," issued in connection with European Patent Application No. 11 864 266.9, dated Apr. 29, 2015, 8 pages.
(Continued)

*Primary Examiner* — Julian Huffman
(74) *Attorney, Agent, or Firm* — HP Inc.—Patent Department

(57) ABSTRACT

Systems and methods for degassing fluid are disclosed. An example fluid ejection device including a channel having an entrance and an exit; a supply slot in communication with the channel; a vent; a first bubble impeding structure at the entrance of the channel; and a second bubble impeding structure at an exit of the channel, the first and second bubble impeding structures to retain a bubble within the channel to enable the bubble to be vented through a vent and to deter the bubble from entering the ink supply slot.

20 Claims, 6 Drawing Sheets

Related U.S. Application Data continuation of application No. 13/985,750, filed as application No. PCT/US2011/034491 on Apr. 29, 2011, now Pat. No. 9,315,019.

(51) Int. Cl.

| | |
|---|---|
| ***B41J 2/165*** | (2006.01) |
| ***B41J 2/045*** | (2006.01) |
| *B41J 2/14* | (2006.01) |

(52) U.S. Cl.

CPC ..... *B41J 2/14032* (2013.01); *B41J 2/1652* (2013.01); *B41J 2/18* (2013.01); *B41J 2002/14169* (2013.01); *B41J 2202/07* (2013.01)

(56) References Cited

U.S. PATENT DOCUMENTS

| | | | |
|---|---|---|---|
| 5,406,318 | A | 4/1995 | Moore et al. |
| 5,700,315 | A | 12/1997 | Wenzel |
| 5,731,828 | A | 3/1998 | Ishinaga |
| 5,818,485 | A | 10/1998 | Rezanka |
| 6,244,694 | B1 | 6/2001 | Weber |
| 6,247,798 | B1 | 6/2001 | Cleland et al. |
| 6,250,740 | B1 | 6/2001 | Moghadam |
| 6,283,718 | B1 | 9/2001 | Prosperetti et al. |
| 6,294,101 | B1 | 9/2001 | Silverbrook |
| 6,655,924 | B2 | 12/2003 | Ma |
| 7,384,128 | B2 | 6/2008 | Sheahan |
| 7,465,037 | B2 | 12/2008 | Azimi |
| 7,571,998 | B2 | 8/2009 | Reinten |
| 7,591,523 | B2 | 9/2009 | Sheahan et al. |
| 8,678,576 | B2 | 3/2014 | Edombingo |
| 9,090,084 | B2 | 7/2015 | Govyadinov |
| 2002/0092519 | A1 | 7/2002 | Davis |
| 2002/0112643 | A1 | 8/2002 | Tyvoll |
| 2003/0076372 | A1 | 4/2003 | Asakawa |
| 2004/0085407 | A1 | 5/2004 | Cox et al. |
| 2005/0200662 | A1 | 9/2005 | Eguchi |
| 2006/0044373 | A1 | 3/2006 | Cabal et al. |
| 2006/0209135 | A1 | 9/2006 | Hoisington et al. |
| 2006/0284948 | A1 | 12/2006 | Ikeda |
| 2007/0006735 | A1 | 1/2007 | Olsen |
| 2007/0081035 | A1 | 4/2007 | Worsman et al. |
| 2007/0081036 | A1 | 4/2007 | Silverbrook |
| 2007/0211123 | A1 | 9/2007 | Lee et al. |
| 2008/0252707 | A1 | 10/2008 | Kusunoki |
| 2008/0297577 | A1 | 12/2008 | Wouters et al. |
| 2009/0058968 | A1 | 3/2009 | Lee et al. |
| 2009/0167829 | A1 | 7/2009 | Iijima |
| 2010/0085405 | A1 | 4/2010 | Indorsky et al. |
| 2010/0231654 | A1 | 9/2010 | Worsman |
| 2010/0253748 | A1 | 10/2010 | Clark |
| 2011/0043570 | A1 | 2/2011 | Xie |
| 2012/0200630 | A1 | 8/2012 | Limb et al. |
| 2013/0057622 | A1 | 3/2013 | Govyadinov |
| 2013/0233418 | A1 | 9/2013 | Aldrich |
| 2013/0321541 | A1 | 12/2013 | Govyadinov |

FOREIGN PATENT DOCUMENTS

| | | |
|---|---|---|
| EP | 1072416 | 1/2001 |
| EP | 1151868 | 11/2001 |
| EP | 1516731 | 3/2005 |
| EP | 1607222 | 12/2005 |
| EP | 1676685 | 7/2006 |
| JP | 63147652 | 6/1988 |
| JP | 08207312 | 8/1996 |
| JP | 11157102 | 6/1999 |
| JP | 2001232810 | 8/2001 |
| JP | 2001322099 | 11/2001 |
| JP | 2002160384 | 6/2002 |
| JP | 2006044373 | 2/2006 |
| JP | 2008062396 | 3/2008 |
| JP | 2009202490 | 9/2009 |

OTHER PUBLICATIONS

European Patent Office, "Search Report," issued in connection with European Patent Application No. 11 864 266.9, dated Nov. 13, 2014, 6 pages.

European Patent Office, "Supplementary Search Report," issued in connection with European Patent Application No. 11 864 266.9, dated Mar. 16, 2015, 5 pages.

Japanese Patent Office, "Office Action", issued in connection with Japanese Patent Application No. 2014505118, dated Apr. 14, 2015, 3 pages.

PCT, "International Search Report on Patentability", issued in connection with PCT Patent Application No. PCT/US2011/034491,dated Oct. 29, 2013, 4 pages.

PCT, "International Search Report", issued in connection with PCT Patent Application No. PCT/US2011/034491, dated Jan. 17, 2012, 3 pages.

PCT, "Written Opinion", issued in connection with PCT Patent Application No. PCT Patent Application No. PCT/US2011/034491, dated Jan. 17, 2012, 3 pages.

State Intellectual Office of the People's Republic of China, "First Office Action", issued in connection with Chinese Patent Application No. 201180070500.7 dated Nov. 15, 2014, 6 pages.

State Intellectual Office of the People's Republic of China, "Second Office Action", issued in connection with Chinese Patent Application No. 201180070500.7, dated Jun. 15, 2015, 8 pages.

U.S., "Non-Final Office Action", issued in connection with U.S. Appl. No. 13/985,750, dated Apr. 7, 2015, 72 pages.

U.S., "Non-Final Office Action", issued in connection with U.S. Appl. No. 13/985,750, dated Nov. 9, 2015, 27 pages.

U.S., "Notice of Allowability", issued in connection with U.S. Appl. No. 13/985,750, dated Feb. 8, 2016, 8 pages.

U.S., "Notice of Allowance", issued in connection with U.S. Appl. No. 13/985,750, dated Dec. 9, 2015, 19 pages.

U.S., "Restriction Requirement", issued in connection with U.S. Appl. No. 13/985,750, dated Oct. 9, 2014, 6 pages.

State Intellectual Office of the People's Republic of China, "Third Office Action", issued in connection with Chinese Patent Application No. 201180070500.7, dated Dec. 21, 2015, 8 pages.

Japanese Patent Office, "Office Action", issued in connection with Japanese Patent Application No. 2014505118, dated Sep. 30, 2014, 4 pages.

SYSTEMS AND METHODS FOR DEGASSING FLUID

RELATED APPLICATION

This patent arises from a continuation of U.S. patent application Ser. No. 15/064,487, filed Mar. 8, 2016, which is a continuation of U.S. patent application Ser. No. 13/985,750, filed Aug. 15, 2013, which is a national stage of PCT Application Serial No. PCT/US2011/034491, filed Apr. 29, 2011. Priority is claimed to U.S. patent application Ser. No. 15/064,487, U.S. patent application Ser. No. 13/985,750 and PCT Application Serial No. PCT/US20111034491. U.S. patent application Ser. No. 15/064,487, U.S. patent application Ser. No. 13/985,750 and PCT Application Serial No. PCT/US2011/034491 are hereby incorporated herein by reference in their entireties.

BACKGROUND

Fluid ejection devices in inkjet printers provide drop-on-demand ejection of fluid drops. Inkjet printers print images by ejecting ink drops through a plurality of nozzles onto a print medium, such as a sheet of paper. The nozzles are typically arranged in one or more arrays, such that properly sequenced ejection of ink drops from the nozzles causes characters or other images to be printed on the print medium as the printhead and the print medium move relative to each other. In a specific example, a thermal inkjet printhead ejects drops from a nozzle by passing electrical current through a heating element to generate heat and vaporize a small portion of the fluid within a firing chamber. In another example, a piezoelectric inkjet printhead uses a piezoelectric material actuator to generate pressure pulses that force ink drops out of a nozzle.

Although inkjet printers provide high print quality at reasonable cost, continued improvement relies on overcoming various challenges that remain in their development. One challenge, for example, is managing air bubbles that develop in inkjet printheads. The presence of air bubbles in channels that carry ink to printhead nozzles often results in faulty nozzle performance and reduced print quality. Ink and other fluids contain varying amounts of dissolved air. However, as ink temperature increases, the solubility of air in the ink decreases, which results in the formation of air bubbles in the ink. Higher drop ejection frequencies (i.e., firing frequencies) in printheads also cause an increase in the formation of air bubbles in the ink, in addition to causing increased temperatures. Therefore, the formation of unwanted air bubbles in ink delivery systems of inkjet printheads is an ongoing challenge as higher drop ejection frequencies are used to achieve increased printing speeds.

BRIEF DESCRIPTION OF THE DRAWINGS

The present embodiments will now be described, by way of example, with reference to the accompanying drawings, in which.

DETAILED DESCRIPTION

Overview

Figure 1:
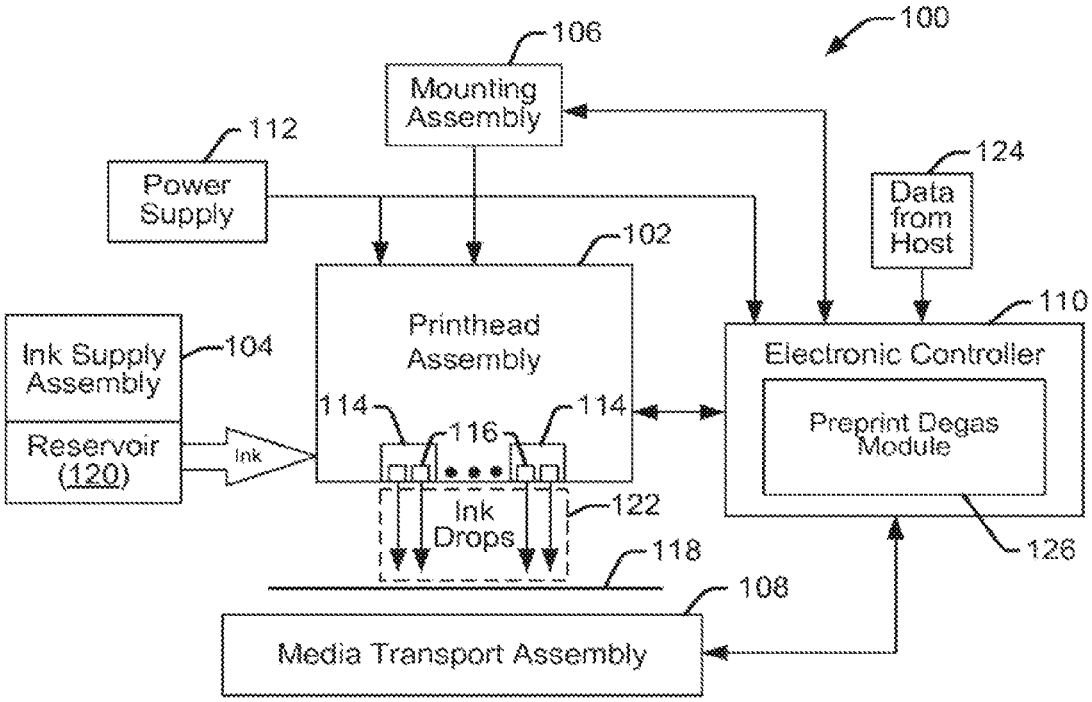
FIG. 1 illustrates a fluid ejection device embodied as an inkjet printing system that is suitable for implementing systems and methods for degassing ink as disclosed herein, according to an embodiment.

As noted above, the presence of air bubbles in the ink delivery system of an inkjet printhead can result in poor inkjet nozzle performance and reduced print quality from an inkjet printer. Air accumulation in the ink delivery system can block the flow of ink, starving the pen for ink and causing the pen to fail during firing. To reduce problems associated with air bubbles in inkjet printheads, ink is often degassed prior to putting it into ink delivery systems. Degassing ink extracts dissolved air and other gasses from the ink.

Various methods have been used for degassing ink. One method, for example, is to pass the ink through a porous tube while transferring it from an ink supply to the printhead. The porous tube has a hydrophobic membrane permeable for gas molecules but not for H2O (or ink), and one side of the tube is exposed to a vacuum. Dissolved air can be desorbed and removed, producing degassed ink. The ink stays inside the tube/membrane while the gas molecules go through membrane and are evacuated by a low vacuum. Another method of degassing ink is to heat it. Heating the ink reduces the solubility of air in the ink causing air bubbles to release from the ink. Adding a chemical is yet another way to degas ink. Unfortunately, such methods can be expensive and may not work well with low and medium printer usage. While most ink delivery systems are airtight, air can still enter the system (e.g., when ink is being replenished) and the process of air dissolving back into the ink is ongoing. Therefore, even previously degassed ink contains dissolved air that can result in the formation of air bubbles during printing that cause problems such as ink blockage and poor inkjet nozzle performance.

Embodiments of the present disclosure improve on prior methods of managing air bubbles in inkjet pen assemblies, in general, by generating localized nucleation sites to stimulate air bubble formation and venting the air bubbles through printhead nozzles to the surrounding atmosphere. Nucleation sites in ejection chambers are generated on a preheated die substrate by sub-TOE (turn-on-energy) pulsing of thermal resistor ejection elements. Air bubbles that form at these nucleation sites are vented into the atmosphere through nozzles, and they are prevented from venting back into the ink supply slot (i.e., ink delivery system) by bubble-impeding structures located between the ejection chambers and the ink supply slot. Nucleation sites are also generated by pulsing (e.g., at full turn-on-energy) thermal resistor pump elements in fluid recirculation channels that loop to and from the ink slot. Air bubbles that form at the pump element nucleation sites located toward one end of the channel, are moved through the channel into the ejection chamber located toward the other end of the channel. These air bubbles are prevented from venting back into the ink slot by bubble-impeding structures located at both ends of the channel. The air bubbles are vented through the nozzles. Air bubble venting through the nozzles can be stimulated by pump element actuation and/or by sub-TOE pulsing of the ejection element in the ejection chamber, both of which can disrupt the ink meniscus in the nozzle and/or disrupt the surface tension of the bubble.

In one embodiment, a method of degassing ink in a fluid ejection device includes generating a localized nucleation site within an ejection chamber of the fluid ejection device, and forming an air bubble at the nucleation site. The method includes preventing the air bubble from venting into an ink supply slot using a bubble-impeding structure, and venting the air bubble through a nozzle associated with the ejection chamber and into the atmosphere.

In another embodiment, a method of degassing ink in a fluid ejection device includes generating a nucleation site with a pump element in a fluidic recirculation channel and forming an air bubble at the nucleation site. The method includes moving the air bubble through the channel to an ejection chamber, and venting the air bubble through a nozzle associated with the ejection chamber. The air bubble is prevented from venting back into an ink supply slot by a bubble-impeding structure. In one implementation, a second nucleation site is generated with an ejection element in the ejection chamber and a second air bubble is formed at the second nucleation site. The second air bubble is vented through the nozzle and prevented from venting into an ink supply slot using a bubble-impeding structure.

In another embodiment, a system for degassing ink in a fluid ejection device includes a fluidic chamber having an associated firing element and nozzle. An ink supply slot is in fluid communication with the fluidic chamber, and a controller is configured to control drop ejections through the nozzle by activating the firing element. The system includes a degassing module executable on the controller to generate a nucleation site within the chamber through repeated, sub-turn-on-energy activations of the firing element. A bubble-impeding structure is located between the fluidic chamber and the ink supply slot to prevent an air bubble formed at the nucleation site from venting into the ink supply slot.

Illustrative Embodiments

FIG. 1 illustrates a fluid ejection device embodied as an inkjet printing system 100 that is suitable for implementing systems and methods for degassing ink as disclosed herein, according to an embodiment of the disclosure. In this embodiment, a fluid ejection assembly is disclosed as fluid drop jetting printhead 114. Inkjet printing system 100 includes an inkjet printhead assembly 102, an ink supply assembly 104, a mounting assembly 106, a media transport assembly 108, an electronic printer controller 110, and at least one power supply 112 that provides power to the various electrical components of inkjet printing system 100. Inkjet printhead assembly 102 includes at least one fluid ejection assembly 114 (printhead 114) that ejects drops of ink through a plurality of orifices or nozzles 116 toward a print medium 118 so as to print onto print media 118. Print media 118 is any type of suitable sheet or roll material, such as paper, card stock, transparencies, Mylar, and the like. Typically, nozzles 116 are arranged in one or more columns or arrays such that properly sequenced ejection of ink from nozzles 116 causes characters, symbols, and/or other graphics or images to be printed upon print media 118 as inkjet printhead assembly 102 and print media 118 are moved relative to each other.

Ink supply assembly 104 supplies fluid ink to printhead assembly 102 and includes a reservoir 120 for storing ink. Ink flows from reservoir 120 to inkjet printhead assembly 102. Ink supply assembly 104 and inkjet printhead assembly 102 can form either a one-way ink delivery system or a macro-recirculating ink delivery system. In a one-way ink delivery system, substantially all of the ink supplied to inkjet printhead assembly 102 is consumed during printing. In a macro-recirculating ink delivery system, however, only a portion of the ink supplied to printhead assembly 102 is consumed during printing. Ink not consumed during printing is returned to ink supply assembly 104.

In one embodiment, inkjet printhead assembly 102 and ink supply assembly 104 are housed together in an inkjet cartridge or pen. In another embodiment, ink supply assembly 104 is separate from inkjet printhead assembly 102 and supplies ink to inkjet printhead assembly 102 through an interface connection, such as a supply tube. In either embodiment, reservoir 120 of ink supply assembly 104 may be removed, replaced, and/or refilled. In one embodiment, where inkjet printhead assembly 102 and ink supply assembly 104 are housed together in an inkjet cartridge, reservoir 120 includes a local reservoir located within the cartridge as well as a larger reservoir located separately from the cartridge. The separate, larger reservoir serves to refill the local reservoir. Accordingly, the separate, larger reservoir and/or the local reservoir may be removed, replaced, and/or refilled.

Mounting assembly 106 positions inkjet printhead assembly 102 relative to media transport assembly 108, and media transport assembly 108 positions print media 118 relative to inkjet printhead assembly 102. Thus, a print zone 122 is defined adjacent to nozzles 116 in an area between inkjet printhead assembly 102 and print media 118. In one embodiment, inkjet printhead assembly 102 is a scanning type printhead assembly. As such, mounting assembly 106 includes a carriage for moving inkjet printhead assembly 102 relative to media transport assembly 108 to scan print media 118. In another embodiment, inkjet printhead assembly 102 is a non-scanning type printhead assembly. As such, mounting assembly 106 fixes inkjet printhead assembly 102 at a prescribed position relative to media transport assembly 108. Thus, media transport assembly 108 positions print media 118 relative to inkjet printhead assembly 102.

Electronic printer controller 110 typically includes a processor, firmware, software, one or more memory components including volatile and no-volatile memory components, and other printer electronics for communicating with and controlling inkjet printhead assembly 102, mounting assembly 106, and media transport assembly 108. Electronic controller 110 receives data 124 from a host system, such as a computer, and temporarily stores data 124 in a memory. Typically, data 124 is sent to inkjet printing system 100 along an electronic, infrared, optical, or other information transfer path. Data 124 represents, for example, a document and/or file to be printed. As such, data 124 forms a print job for inkjet printing system 100 and includes one or more print job commands and/or command parameters.

In one embodiment, electronic printer controller 110 controls inkjet printhead assembly 102 for ejection of ink drops from nozzles 116. Thus, electronic controller 110 defines a pattern of ejected ink drops that form characters, symbols, and/or other graphics or images on print media 118. The pattern of ejected ink drops is determined by the print job commands and/or command parameters. In one embodiment, electronic controller 110 includes preprint degas module 126 stored in a memory of controller 110. The preprint degas module 126 executes on electronic controller 110 (i.e., a processor of controller 110) to perform a pre-printing algorithm for degassing ink. That is, preprint degas module 126 executes on controller 110 to degas ink in printhead assembly 102 prior to the start of normal printing operations in inkjet printing system 100. More specifically, preprint degas module 126 controls the activation of thermal resistor firing elements in printheads 114 through repeated, sub-TOE (turn-on-energy) pulses to generate localized nucleation sites within ejection chambers (i.e., firing chambers) of the printheads. In addition, for printheads 114 having micro-recirculation channels, preprint degas module 126 also controls the activation of thermal resistor pump elements within the micro-recirculation channels through repeated, full-TOE (turn-on-energy) pulses to generate localized nucleation sites within the micro-recirculation channels. Preprint degas module 126 controls pump elements within the micro-recirculation channels to move air bubbles formed at nucleation sites through the channels to ejection chambers. Preprint degas module 126 also controls pump elements and ejection elements to facilitate the venting of air bubbles through nozzles by activating the elements to cause disruption of ink meniscus and/or air bubble surface tension within nozzles.

In one embodiment, inkjet printhead assembly 102 includes one fluid ejection assembly (printhead) 114. In another embodiment, inkjet printhead assembly 102 is a wide array or multi-head printhead assembly. In one wide-array embodiment, inkjet printhead assembly 102 includes a carrier that carries fluid ejection assemblies 114, provides electrical communication between fluid ejection assemblies 114 and electronic controller 110, and provides fluidic communication between fluid ejection assemblies 114 and ink supply assembly 104.

In one embodiment, inkjet printing system 100 is a drop-on-demand thermal bubble inkjet printing system wherein the fluid ejection assembly 114 is a thermal inkjet (TIJ) printhead 114. The thermal inkjet printhead implements a thermal resistor ejection element in an ink ejection chamber to vaporize ink and create bubbles that force ink or other fluid drops out of a nozzle 116.

Figure 2:
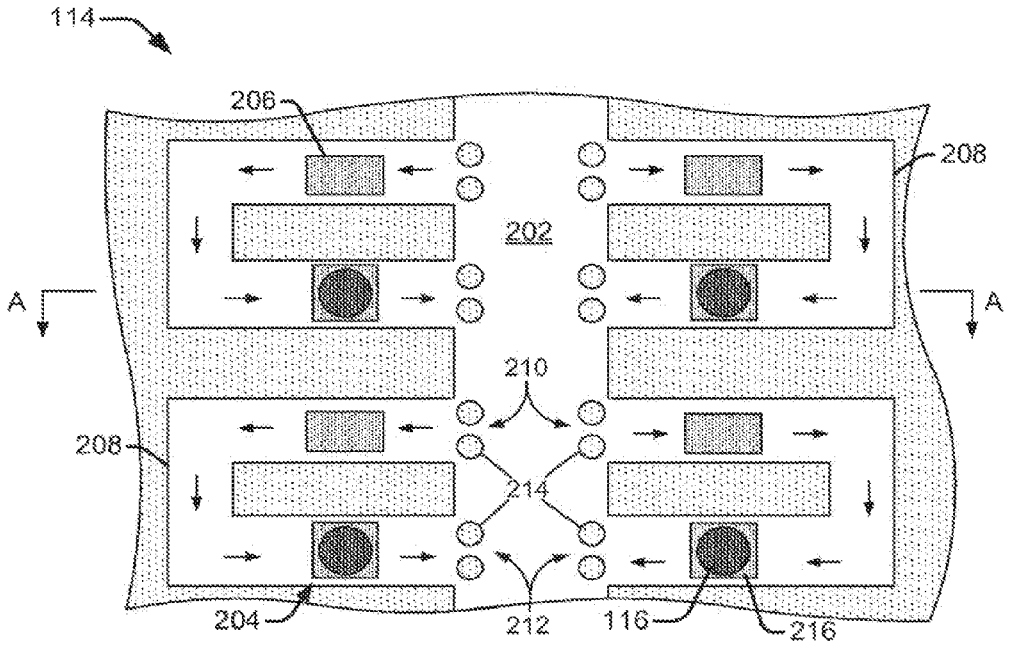
FIG. 2 shows a top-down view of a thermal inkjet (TIJ) printhead having a plurality of micro-recirculation channels, according to an embodiment.
Figure 3:
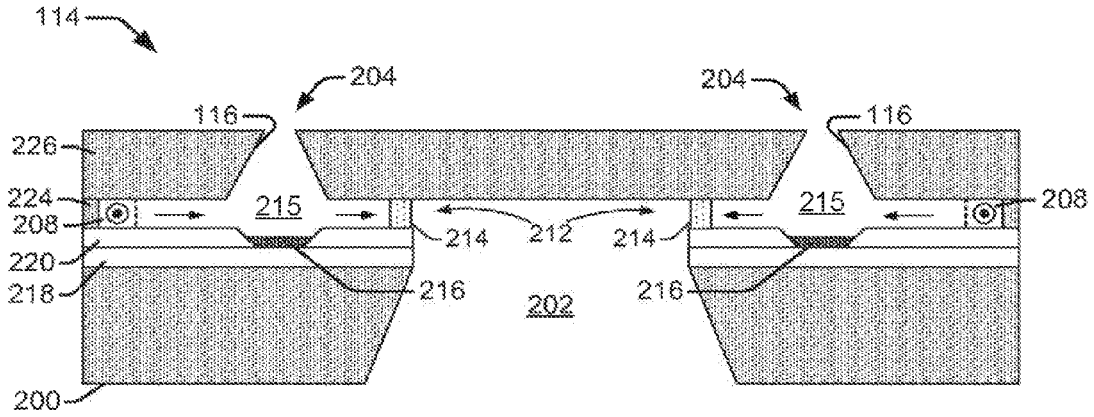
FIG. 3 shows a cross-sectional view of one embodiment of the TIJ printhead of FIG. 2, according to an embodiment.

FIG. 2 shows a top-down view of a thermal inkjet (TIJ) printhead 114 having a plurality of micro-recirculation channels, according to an embodiment of the disclosure. FIG. 3 shows a cross-sectional view of one embodiment of the TIJ printhead 114 taken along line A-A of FIG. 2. Although one micro-recirculation channel design with single "U-shaped" loops is illustrated and discussed, other recirculation channel designs with varying numbers and configurations of recirculation loops are possible and contemplated. Thus, the illustrated micro-recirculation channel design with single "U-shaped" loops of FIGS. 2 and 3 is presented here by way of example only, and not by way of limitation. Referring generally to FIGS. 2 and 3, the TIJ printhead 114 includes a substrate 200 with an ink supply slot 202 formed therein. The TIJ printhead 114 also includes a chamber layer 224 having walls and ejection chambers 214 that separate the substrate 200 from a nozzle layer 226 having nozzles 116. The ink supply slot 202 is an elongated slot extending into the plane of FIG. 3 that is in fluid communication with an ink supply (not shown), such as a fluid reservoir 120. In general, ink from ink supply slot 202 circulates through drop generators 204 based on flow induced by a fluid pump element 206.

Drop generators 204 are arranged on either side of the ink supply slot 202 and along the length of the slot extending into the plane of FIG. 3. Each drop generator 204 includes a nozzle 116, an ejection chamber 214, and an ejection element 216 disposed within the chamber 214. Ejection element 216 operates to eject fluid drops through a corresponding nozzle 116. In the illustrated embodiment, the ejection element 216 and the fluid pump element 206 are thermal resistors formed, for example, of an oxide layer 218 on a top surface of the substrate 200 and a thin film stack 220 applied on top of the oxide layer 218. The thin film stack 220 generally includes an oxide layer, a metal layer defining the ejection element 216 and pump element 206, conductive traces, and a passivation layer. During a normal printing operation, controller 110 controls TIJ printhead 114 to eject ink droplets through a nozzle 116 by passing electrical current through a ejection element 216 which generates heat and vaporizes a small portion of the ink within firing chamber 214. When a current pulse is supplied, the heat generated by the ejection element 216 creates a rapidly expanding vapor bubble that forces a small ink droplet out of the firing chamber nozzle 116. When the heating element cools, the vapor bubble quickly collapses, drawing more ink into the firing chamber.

As indicated by the black direction arrows, the pump element 206 pumps ink from the ink supply slot 202 through a fluidic micro-recirculation channel 208. The recirculation channel includes a channel inlet 210 providing a fluidic passageway to the ink supply slot 202, and a channel outlet 212 providing another passageway to the ink supply slot 202. At the channel inlets 210 and channel outlets 212 are air bubble-impeding structures 214. The bubble-impeding structures 214 are located with respect to one another and with respect to the walls of the chamber layer 224 such that they provide a minimum clearance that prevents air bubbles formed in the channel 208 from passing into the ink supply slot 202. A typical minimum clearance between the structures 214 and walls is approximately 7 microns, but the clearance may vary in the range of approximately 1 micron to approximately 10 microns depending on the characteristics of the ink being used in the printhead 114.

Figure 4:
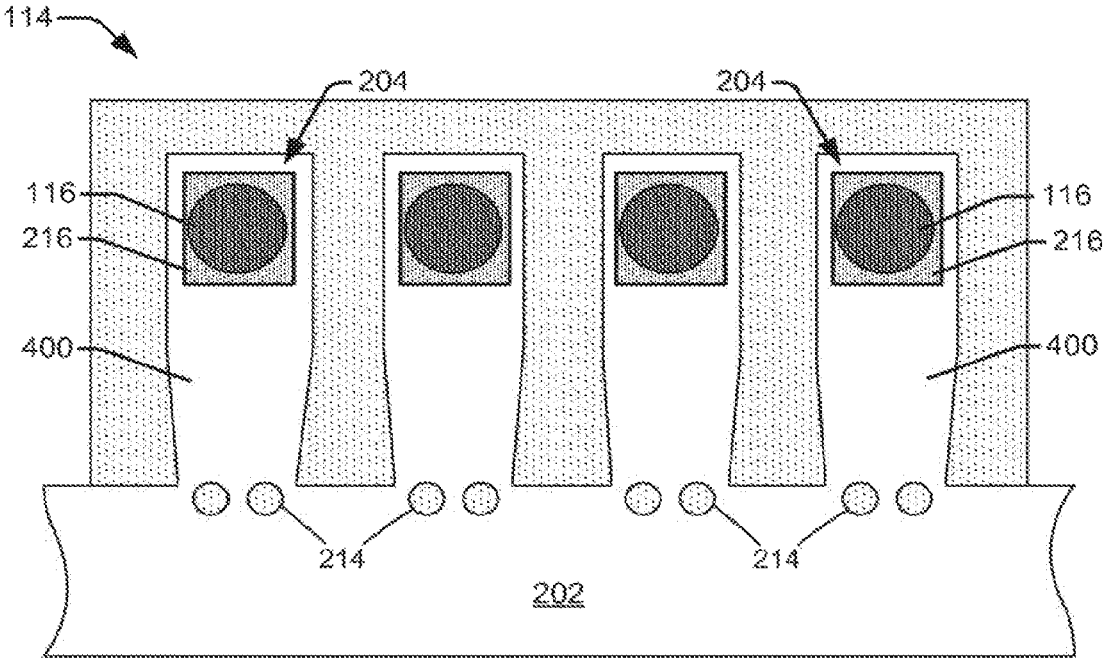
FIG. 4 shows a top-down view of a thermal inkjet (TIJ) printhead having a third-wall design with a single channel leading from the ink supply slot to a drop generator, according to an embodiment.

FIG. 4 shows a top-down view of a thermal inkjet (TIJ) printhead 114 having a third-wall design with a single channel 400 leading from the ink supply slot 202 to the drop generator 204 (i.e., the nozzle 116, ejection chamber 214, and thermal resistor ejection element 216), according to an embodiment of the disclosure. The general printing operation of printhead 114 in FIG. 4 is the same as described for FIGS. 2 and 3 above. However, there is no recirculation channel or pump element in the printhead 114 of FIG. 4. Therefore, the collapsing vapor bubble draws more ink from the ink supply slot 202 to the drop generator 204 after each drop ejection event in preparation for ejecting another drop from the nozzle 116, as indicated by the black direction arrows.

Figure 5:
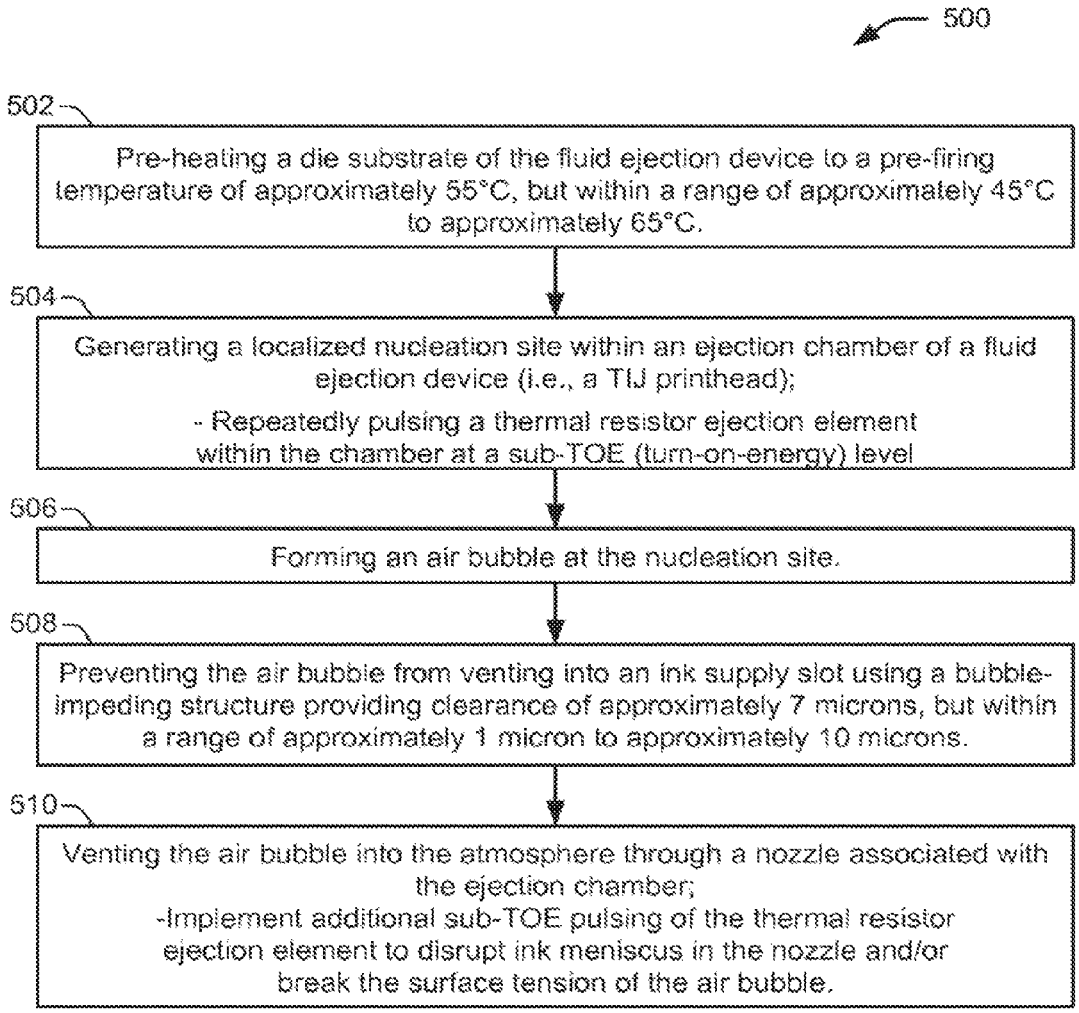
FIG. 5 shows a flowchart of an example method of degassing ink in a fluid ejection device, according to an embodiment.

Prior to a normal printing operation where printhead 114 ejects ink drops through nozzles 116 to form images on a print medium 118, the controller 110 executes a preprint degas module 126 to implement an ink degassing method. FIG. 5 shows a flowchart of an example method 500 of degassing ink in a fluid ejection device 114 (e.g., a printhead 114), according to an embodiment of the disclosure. Method 500 is associated with the embodiments discussed above with respect to illustrations in FIGS. 1-4. The general degassing method applies similarly to printheads 114 having various architectures, such as those shown and described in FIGS. 2-4.

Method 500 begins at block 502 with pre-heating the die substrate of the fluid ejection device 114 to a pre-firing temperature. The die is typically pre-heated to improve ink performance by reducing ink surface tension and reducing ink viscosity, which improves drop weight and drop velocity. In the degassing method 500, pre-heating the die substrate helps to stimulate air bubble growth at the localized nucleation sites. A typical pre-heating temperature is approximately 55° C., but pre-heating temperatures within the range of approximately 45° C. to approximately 65° C. may be advantageous.

At block 504 of method 500, a localized nucleation site is generated within an ejection chamber of a fluid ejection device 114. Generating a localized nucleation site includes repeatedly pulsing a thermal resistor ejection element within the chamber at a sub-TOE (turn-on-energy) level. Pulsing the thermal ejection element with sub-TOE prevents the full activation of the ejection element and prevents an ink drop from being ejected. The sub-TOE pulses partially activate the ejection element, causing smaller vapor bubbles that are not large enough to eject an ink drop. Upon the collapse of each vapor bubble, residual air evolved from the superheated fluid ink accumulates to form a remnant air bubble in the local area of the thermal ejection element. After a number of pulsing events, the remnant air bubble reaches a critical size and becomes a nucleation site for the growth or formation of an air bubble, as shown at block 506.

The degassing method 500 continues at block 508 with preventing the air bubble from venting into an ink supply slot 202 using a bubble-impeding structure 214. Bubble-impeding structures are located with respect to one another, and with respect to the walls of printhead chamber layer 224, in a manner that provides a minimum clearance to prevent air bubbles from passing into the ink supply slot 202. A typical minimum clearance between the structures 214 and walls is approximately 7 microns, but the clearance may vary in the range of approximately 1 micron to approximately 10 microns depending on the characteristics of the ink being used in the printhead 114.

At block 510 of the degassing method 500, the air bubble is vented into the atmosphere through a nozzle associated with the ejection chamber. The venting can be facilitated by additional sub-TOE pulsing of the thermal resistor ejection element which can disrupt an ink meniscus in the nozzle and/or break the surface tension of the air bubble.

Figure 6:
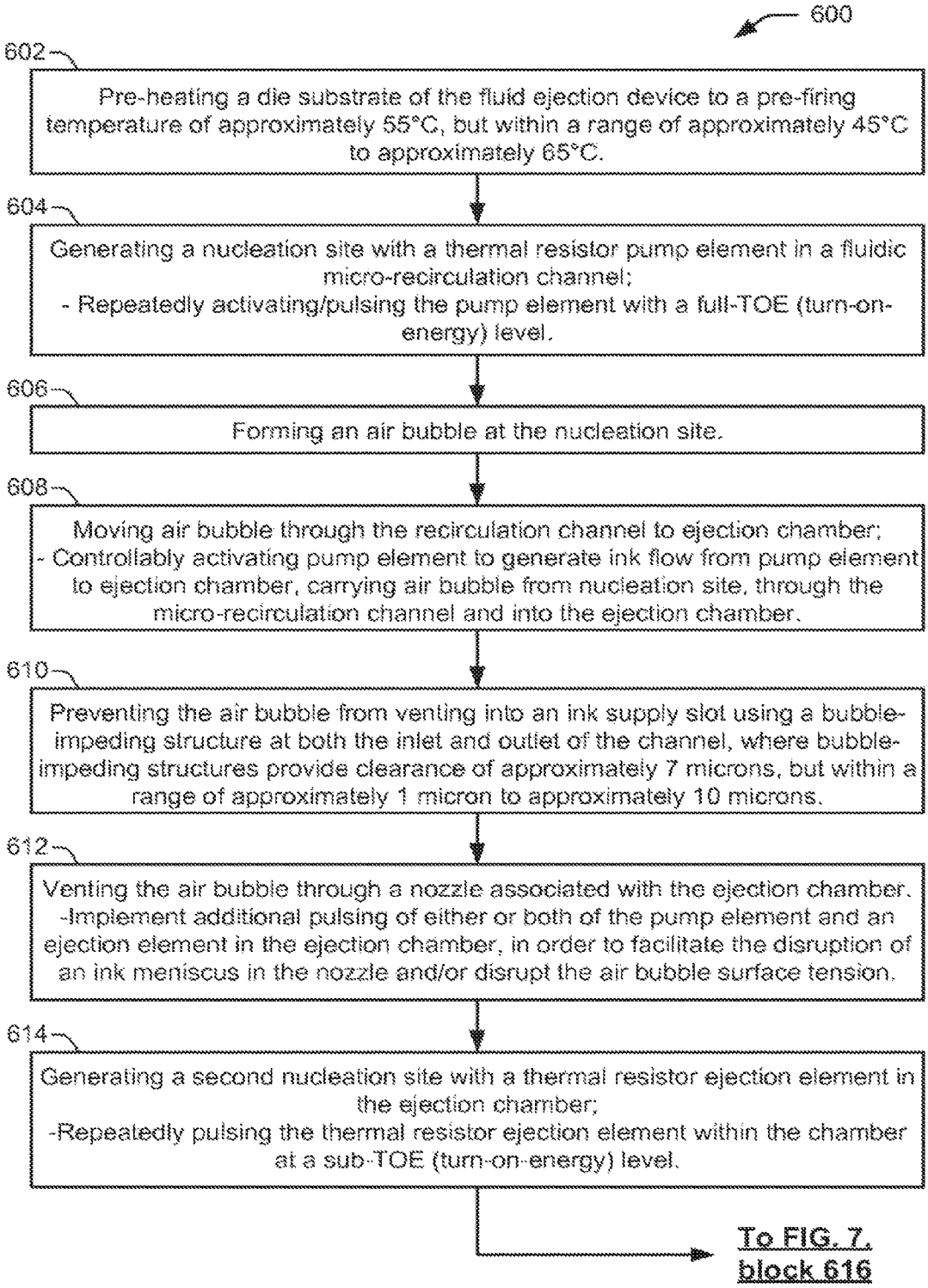
FIG. 6 shows a flowchart of an example method of degassing ink in a fluid ejection device, according to an embodiment.

FIG. 6 shows a flowchart of an example method 600 of degassing ink in a fluid ejection device 114 (e.g., a printhead 114), according to an embodiment of the disclosure. Method 600 is associated with the embodiments discussed above with respect to illustrations in FIGS. 1-4. The degassing method 600 generally applies to printheads 114 having various architectures, such as those shown and described in FIGS. 2-4.

Method 600 begins at block 602 with pre-heating the die substrate of the fluid ejection device 114 is to a pre-firing temperature of approximately 55° C., but within the range of approximately 45° C. to approximately 65° C. in order to help stimulate air bubble growth at the localized nucleation sites.

At block 604 of method 600, a nucleation site is generated with a thermal resistor pump element in a fluidic micro-recirculation channel. Generating a nucleation site with a pump element includes repeatedly activating the pump element with a full-TOE (turn-on-energy) level. Pulsing the thermal resistor pump element with full-TOE fully activates the pump element to cause vapor bubble formation within the micro-recirculation channel. Upon the collapse of each vapor bubble, residual air evolved from the superheated fluid ink accumulates to form a remnant air bubble in the local area of the thermal resistor pump element. After a number of pulsing events, the remnant air bubble reaches a critical size and becomes a nucleation site for the growth or formation of an air bubble, as shown at block 606.

The degassing method 600 continues at block 608 with moving the air bubble through the micro-recirculation channel to an ejection chamber. Moving the air bubble through the channel to an ejection chamber includes controllably activating the pump element (i.e., with controller 110) to generate fluid/ink flow from the pump element to the ejection chamber. The flow of ink carries the air bubble from the nucleation site at the pump element near the channel inlet, through the micro-recirculation channel and into the ejection chamber near the channel outlet.

At block 610 of method 600, the air bubble is prevented from venting into an ink supply slot using a bubble-impeding structure. Because there is an inlet and outlet of the micro-recirculation channel coupled with the ink supply slot, preventing the air bubble from venting into the ink supply slot includes using a bubble-impeding structure at both the inlet and outlet of the channel. As noted above, bubble-impeding structures are located with respect to one another, and with respect to the walls of a printhead chamber layer 224, in a manner that provides a minimum clearance (e.g., in the range of 1 to 10 microns, typically closer to 7 microns) to prevent air bubbles from passing into the ink supply slot 202.

At block 612 of method 600, the air bubble is vented through a nozzle associated with the ejection chamber. Venting the air bubble formed at a nucleation site stimulated by a pump element can include additional pulsing of either or both of the pump element and an ejection element in the ejection chamber, in order to facilitate the disruption of an ink meniscus in the nozzle and/or disrupt the air bubble surface tension.

Figure 7:
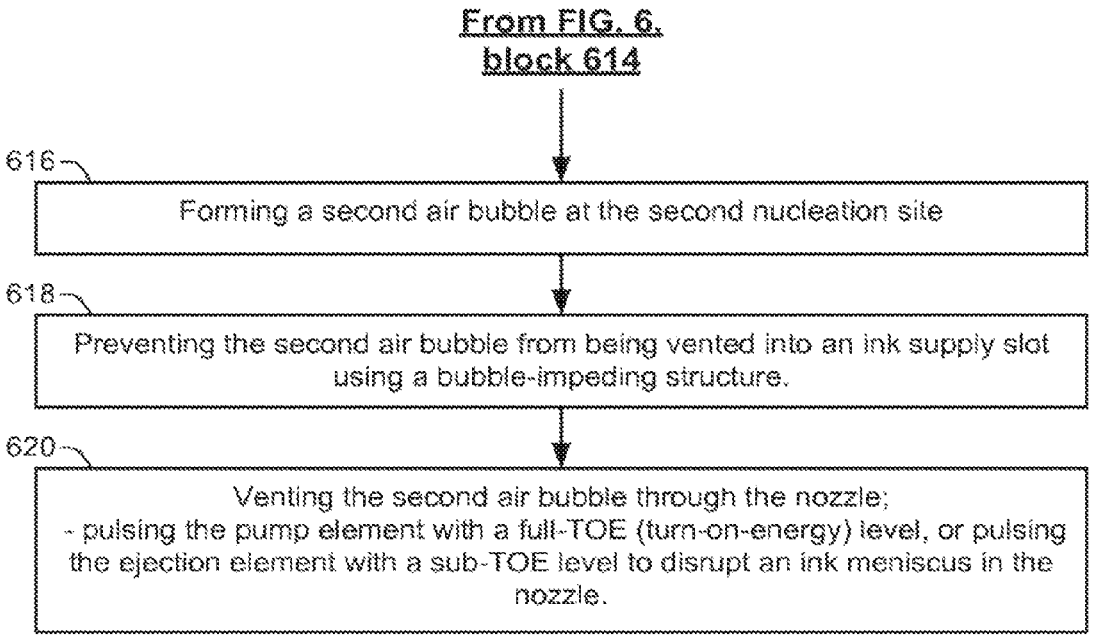
FIG. 7 shows a continuation of the flowchart of FIG. 6, showing an example method of degassing ink in a fluid ejection device, according to an embodiment.

The method 600 continues at block 614 with generating a second nucleation site with a thermal resistor ejection element in the ejection chamber. Generating a second nucleation site includes repeatedly pulsing the thermal resistor ejection element within the chamber at a sub-TOE (turn-on-energy) level. The pulsing or activation of the thermal resistor ejection element is timed so as not to occur during activation of the pump element. The method 600 continues at FIG. 7, block 616, where a second air bubble is formed at the second nucleation site. At block 618, the second air bubble is prevented from being vented into an ink supply slot using a bubble-impeding structure such as the bubble-impeding structure described above. The second air bubble is then vented through the nozzle as shown at block 620. Venting the second air bubble through the nozzle can include pulsing the pump element with a full-TOE (turn-on-energy) level, or pulsing the ejection element with a sub-TOE level to disrupt an ink meniscus in the nozzle.

An example method of degassing ink in a fluid ejection device, comprising: generating a localized nucleation site within an ejection chamber of a fluid ejection device; forming an air bubble at the nucleation site; preventing the air bubble from venting into an ink supply slot using a bubble-impeding structure; and venting the air bubble through a nozzle associated with the ejection chamber and into the atmosphere. In some example, the bubble-impeding structure is located in a passageway between the ejection chamber and the ink supply slot, the method further comprising providing a minimum clearance between the bubble-impeding structure and walls of the passageway. In some examples, generating a localized nucleation site comprises repeatedly pulsing a thermal ejection element within the chamber at a sub-turn-on-energy level. In some examples, the method includes pre-heating a die substrate of the fluid ejection device to a pre-firing temperature. In some examples, pre-heating the die substrate comprises pre-heating the die substrate to a temperature within a range of 45° C. to 65° C.

An example system for degassing ink in a fluid ejection device comprising: a fluidic chamber having an associated firing element and nozzle; an ink supply slot in fluid communication with the fluidic chamber; a controller to control drop ejections through the nozzle by activating the firing element; and a degassing module executable on the controller to generate a nucleation site within the chamber through repeated, sub-turn-on-energy activations of the firing element; and a bubble-impeding structure between the fluidic chamber and the ink supply slot to prevent an air bubble formed on the nucleation site from venting into the ink supply slot.

In some examples, the system a recirculation channel having first and second ends coupled with the ink supply slot; a pump element located toward the first end of the channel; the fluidic chamber located toward the second end of the channel; wherein the degassing module is configured to generate a second nucleation site through repeated, turn-on-energy activations of the pump element; and a second bubble-impeding structure between the pump element and the ink supply slot to prevent a second air bubble formed on the second nucleation site from venting into the ink supply slot. In some examples, the bubble-impeding structure provides a clearance that ranges between approximately 1 micron and approximately 10 microns.

An example method of degassing ink in a fluid ejection device, comprising: generating a nucleation site with a pump element in a fluidic micro-recirculation channel; forming an air bubble at the nucleation site; moving the air bubble through the channel to an ejection chamber; preventing the air bubble from venting into an ink supply slot using a bubble-impeding structure; and venting the air bubble through a nozzle associated with the ejection chamber. In some examples, the method includes generating a second nucleation site with an ejection element in the ejection chamber; forming a second air bubble at the second nucleation site; preventing the second air bubble from venting into an ink supply slot using a bubble-impeding structure; and venting the second air bubble through the nozzle. In some examples, generating a nucleation site with a pump element comprises repeatedly activating the pump element with a full-TOE (turn-on-energy) level; and generating a second nucleation site with an ejection element comprises repeatedly activating the ejection element with a sub-TOE level. In some examples, preventing the air bubble from venting into an ink supply slot using a bubble-impeding structure includes using a first bubble-impeding structure at an inlet of the channel nearest the pump element; and using a second bubble-impeding structure at an outlet of the channel nearest the ejection element.

In some examples, activation of the pump element is timed so as not to occur during activation of the ejection element. In some examples, venting the air bubble through the nozzle comprises breaking a meniscus of ink in the nozzle by activating the pump element. In some examples, venting the air bubble and venting the second air bubble comprises pulsing the pump element with a full-TOE (turn-on-energy) level, or pulsing the ejection element with a sub-TOE level to disrupt an ink meniscus in the nozzle. In some examples, moving the air bubble through the channel to an ejection chamber comprises activating the pump element to generate fluid flow from the pump element to the ejection chamber. In some examples, the method includes pre-heating a die substrate of the fluid ejection device to a pre-firing temperature within a range of 45° C. to 65° C.

An example method of degassing ink in a fluid ejection device, comprising: generating a localized nucleation site within an ejection chamber of a fluid ejection device; forming an air bubble at the nucleation site; preventing the air bubble from venting into an ink supply slot using: a first bubble-impeding structure at an inlet of a channel, the channel in communication with the ink supply slot; and a second bubble-impeding structure at an outlet of the channel; and venting the air bubble through a nozzle associated with the ejection chamber and into the atmosphere.

In some examples, the second bubble-impeding structure is disposed in the channel between the ejection chamber and the ink supply slot. In some examples, the generating of the localized nucleation site includes repeatedly pulsing a thermal ejection element within the ejection chamber at a sub-turn-on-energy level. In some examples, the method includes pre-heating a die substrate of the fluid ejection device to a pre-firing temperature. In some examples, the pre-heating of the die substrate includes pre-heating the die substrate to a temperature within a range of approximately 45° C. and approximately 65° C.

An example system for degassing ink in a fluid ejection device comprising: a fluidic chamber having a firing element and a nozzle; an ink supply slot in fluid communication with the fluidic chamber; a controller to control drop ejections through the nozzle by activating the firing element; a degassing module executable on the controller to generate a first nucleation site within the fluidic chamber through repeated, sub-turn-on-energy activations of the firing element and to generate a second nucleation site through repeated, turn-on-energy activations of a pump; and a bubble-impeding structure between the fluidic chamber and the ink supply slot to prevent an air bubble formed on the nucleation site from venting into the ink supply slot.

An example system for degassing ink in a fluid ejection device, comprising: a fluidic chamber having a firing element and a nozzle; an ink supply slot in fluid communication with the fluidic chamber; a controller to control drop ejections through the nozzle by activating the firing element; a degassing module executable on the controller to generate a nucleation site within the fluidic chamber through repeated, sub-turn-on-energy activations of the firing element; a bubble-impeding structure between the fluidic chamber and the ink supply slot to prevent an air bubble formed on the nucleation site from venting into the ink supply slot; a recirculation channel having first and second ends in communication with the ink supply slot; a pump located toward the first end of the channel, the degassing module is to generate a second nucleation site through repeated, turn-on-energy activations of the pump; the fluidic chamber located toward the second end of the channel; and a second bubble-impeding structure between the pump and the ink supply slot to prevent a second air bubble formed on the second nucleation site from venting into the ink supply slot. In some examples, the bubble-impeding structure provides a clearance that ranges between approximately 1 micron and approximately 10 microns.

An example method of degassing ink in a fluid ejection device, comprising: generating a nucleation site with a pump in a fluidic micro-recirculation channel; forming an air bubble at the nucleation site; moving the air bubble through the channel to an ejection chamber; preventing the air bubble from venting into an ink supply slot using: a first bubble-impeding structure at an inlet of the channel nearest the pump; and a second bubble-impeding structure at an outlet of the channel nearest an ejection element; and venting the air bubble through a nozzle associated with the ejection chamber. In some examples, the method includes generating a second nucleation site with the ejection element in the ejection chamber; forming a second air bubble at the second nucleation site; preventing the second air bubble from venting into an ink supply slot using at least one of the first bubble-impeding structure or the second bubble-impeding structure; and venting the second air bubble through the nozzle.

An example method of degassing ink in a fluid ejection device, comprising: generating a nucleation site with a pump in a fluidic micro-recirculation channel; forming an air bubble at the nucleation site by repeatedly activating the pump with a full level; moving the air bubble through the channel to an ejection chamber; preventing the air bubble from venting into an ink supply slot using a bubble-impeding structure; venting the air bubble through a nozzle associated with the ejection chamber; generating a second nucleation site with an ejection element in the ejection chamber including by repeatedly activating the ejection element with a sub turn-on-energy level; forming a second air bubble at the second nucleation site; preventing the second air bubble from venting into an ink supply slot using the bubble-impeding structure; and venting the second air bubble through the nozzle.

An example method of degassing ink in a fluid ejection device, comprising: generating a nucleation site with a pump in a fluidic micro-recirculation channel; forming an air bubble at the nucleation site; moving the air bubble through the channel to an ejection chamber; preventing the air bubble from venting into an ink supply slot using a bubble-impeding structure, wherein preventing the air bubble from venting into ink supply slot using: a first bubble-impeding structure at an inlet of the channel nearest the pump; and a second bubble-impeding structure at an outlet of the channel nearest an ejection element; venting the air bubble through a nozzle associated with the ejection chamber; generating a second nucleation site with the ejection element in the ejection chamber; forming a second air bubble at the second nucleation site; preventing the second air bubble from venting into an ink supply slot using at least one of the first bubble-impeding structure or the second bubble-impeding structure; and venting the second air bubble through the nozzle.

In some examples, the activation of the pump is timed so as not to occur during the activation of the ejection element. In some examples, the venting of the air bubble through the nozzle includes breaking a meniscus of ink in the nozzle by activating the pump. In some examples, the venting of the air bubble and the venting of the second air bubble includes pulsing the pump with a full level, or pulsing the ejection element with a sub turn-on-energy level to disrupt an ink meniscus in the nozzle. In some examples, the moving of the air bubble through the channel to the ejection chamber includes activating the pump to generate fluid flow from the pump to the ejection chamber. In some examples, the method includes pre-heating a die substrate of the fluid ejection device to a pre-firing temperature within a range of approximately 45° C. and approximately 65° C. In some examples, the method includes providing a minimum clearance between the bubble-impeding structure and walls of the passageway. In some examples, the bubble-impeding structure includes a first bubble-impeding structure at an inlet of a channel, the channel in communication with the ink supply slot and a second bubble-impeding structure at an outlet of the channel.

What is claimed is:

1. A fluid degassing unit for a printhead, the unit comprising:

an elongated recirculation path for providing fluid to the printhead and receiving unused fluid back from the printhead;

an ejection chamber with a firing element and a nozzle, the ejection chamber being in the recirculation path to selectively eject drops of fluid;

a controller to operate the firing element as a nucleation site to form gas bubbles during a degassing operation; and a structure to impede gas bubbles formed at the nucleation site from moving through the recirculation path such that gas bubbles are vented through the nozzle.

2. The fluid degassing unit of claim 1, further comprising a degas module implemented by the controller to form the nucleation site by operating the firing element at less than a turn-on-energy (TOE).

3. The fluid degassing unit of claim 2, wherein the controller, when implementing the degas module, sends energy pulses of less than the TOE to the firing element.

4. The fluid degassing unit of claim 1, wherein the elongated recirculation path has an input and an output for communicating fluidly with a fluid reservoir.

5. The fluid degassing unit of claim 1, further comprising a pump element to pump fluid through the recirculation path.

6. The fluid degassing unit of claim 5, the pump element to pump fluid through the recirculation path, under control of the controller, during the degassing operation and move gas bubbles, causing the gas bubbles to exit the nozzle.

7. The fluid degassing unit of claim 1, wherein the recirculation path comprises a plurality of U-shaped sections, each U-shaped section comprising an ejection chamber with a firing element and a nozzle, the controller to selectively operate each firing element as a nucleation site during the degassing operation.

8. The fluid degassing unit of claim 7, wherein the structure to impede gas bubbles comprises an impeding structure at each end of each U-shaped section.

9. The fluid degassing unit of claim 1, wherein the structure to impede gas bubbles comprises two physical obstructions spaced apart to permit fluid, but not gas bubbles to pass.

10. A fluid degassing unit for a printhead, the unit comprising:

an electronic controller to receive data from a host device and, using the data, selectively energize a firing element in each of a plurality of ejection chambers to eject drops of fluid through a nozzle of each ejection chamber;

a degas module in a memory component of the electronic controller, the degas module to, when implemented by the controller during a degassing operation, cause the controller to operate any of the firing elements as a nucleation site to form gas bubbles that are vented through a nozzle.

11. The fluid degassing unit of claim 10, wherein the degas module causes the controller to form the nucleation site by operating a firing element at less than a turn-on-energy (TOE).

12. The fluid degassing unit of claim 10, wherein the controller, when implementing the degas module, sends energy pulses of less than a turn-on-energy (TOE) to a firing element.

13. The fluid degassing unit of claim 10, the controller further to operate a pump element to pump fluid through a recirculation path that includes the ejection chambers.

14. The fluid degassing unit of claim 13, the controller to operate the pump element to pump fluid through the recirculation path during the degassing operation so as to move gas bubbles, causing the gas bubbles to exit a nozzle.

15. A fluid degassing unit for a fluid ejection device, the unit comprising:

a fluid circulation path;

an ejection chamber with a firing element and a nozzle, the ejection chamber being in the fluid circulation path to selectively eject drops of fluid;

a controller to operate the firing element as a nucleation site to form gas bubbles during a degassing operation;

a degas module, implemented by the controller, to form the nucleation site by operating the firing element at less than a turn-on-energy (TOE); and a structure to impede gas bubbles formed at the nucleation site from moving through the circulation path such that gas bubbles are vented through the nozzle.

16. The fluid degassing unit of claim 15, wherein the controller, when implementing the degas module, sends a series of energy pulses of less than the TOE to the firing element.

17. The fluid degassing unit of claim 15, further comprising a pump element, under control of the controller, to pump fluid through the circulation path.

18. The fluid degassing unit of claim 17, the pump element to pump fluid through the circulation path during the degassing operation and move gas bubbles, causing the gas bubbles to exit the nozzle.

19. The fluid degassing unit of claim 15, wherein the structure to impede gas bubbles comprises two physical obstructions spaced apart to permit fluid, but not gas bubbles to pass.

20. The fluid degassing unit of claim 19, wherein the two physical obstructions are spaced apart by 1 to 10 microns.

* * * * *